United States Patent [19]

Katayama et al.

[11] Patent Number: 4,501,678

[45] Date of Patent: Feb. 26, 1985

[54] LUBRICANTS FOR IMPROVING FATIGUE LIFE

[75] Inventors: Takao Katayama, Ichihara; Masahiko Takesue, Sodegaura, both of Japan

[73] Assignee: Idemitsu Kosan Company Limited, Tokyo, Japan

[21] Appl. No.: 500,264

[22] Filed: Jun. 2, 1983

[30] Foreign Application Priority Data

Jun. 9, 1982 [JP] Japan ..... 57/97774

[51] Int. Cl.[3] ..... C10M 1/48; C10M 1/38

[52] U.S. Cl. ..... 252/32.7 E; 252/47; 252/47.5; 252/56 R

[58] Field of Search ..... 252/32.7 E, 47, 47.5, 252/56 R

[56] References Cited

U.S. PATENT DOCUMENTS

| | | | |
|---|---|---|---|
| 3,876,550 | 4/1975 | Holubec | 252/47 |
| 4,125,479 | 11/1978 | Chesluk et al. | 252/47.5 |
| 4,360,438 | 11/1982 | Rowan et al. | 252/47.5 |
| 4,428,861 | 1/1984 | Bridger | 252/32.7 E |

*Primary Examiner*—Jacqueline V. Howard

*Attorney, Agent, or Firm*—Frishauf, Holtz, Goodman & Woodward

[57] ABSTRACT

A lubricant for improving fatigue life is described, which comprises: (1) a lubricating base material, and (2) a compound having alkylthiocarbamoyl groups represented by the general formula (i):

(i)

or (1) a lubricating base material, (2) a compound having alkylthiocarbamoyl groups represented by the general formula (i), (3) a molybdenum compound represented by the general formula (ii):

(ii)

or by the general formula (iii):

(iii)

and/or an ester compound. All the symbols in the formulae are as defined in the appended claims. This lubricant greatly prolongs the fatigue life of gears, etc.

20 Claims, 1 Drawing Figure

LUBRICANTS FOR IMPROVING FATIGUE LIFE

FIELD OF THE INVENTION

The present invention relates to lubricants for improving fatigue life, and more particularly to lubricants for improving fatigue life which comprises lubricating base materials and specific polar compounds.

BACKGROUND OF THE INVENTION

For gears used in machine tools, construction machines, automobiles, machines for ships, etc. as well as industrial machines such as rolling mills have heretofore been used lubricants having superior scoring properties so that the gears can withstand high pressure exerted on the tooth faces thereof. Further development of lubricants having more improved scoring properties have been continuously made.

Examination of failures of gears has revealed that scoring occurs only limitedly; rather the fatigue phenomenon such as pitting, is mainly responsible for various troubles. This fatigue phenomenon is also observed for bearings. In connection with the fatigue phenomenon, it is generally known that the fatigue life is prolonged when the viscosity of the lubricant used is increased, whereas the life is reversely shortened when those lubricants containing polar compounds such as extreme pressure additives are used.

Accordingly, as to a procedure for improving the fatigue life of gears, bearings, etc., there have been known no other effective procedures than that in which the amounts of extreme pressure additives, etc. being added are controlled as low as possible, and lubricants having a high viscosity are employed.

SUMMARY OF THE INVENTION

As a result of extensive investigations to develop lubricants which overcome the above-described defects of the conventional lubricants, it has been found that the use of lubricants comprising lubricating base materials and specific polar compounds enables to greatly prolong the fatigue life of gears, etc. without increasing the viscosities of the lubricants.

The present invention relates to: (I) a lubricant for improving fatigue life which comprises:

(1) a lubricating base material; and (2) a compound having alkylthiocarbamoyl groups (hereinafter referred to as "Compound (a)") represented by the general formula (i):

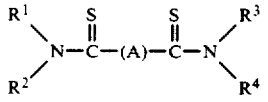

(i)

(wherein $R^1$, $R^2$, $R^3$, and $R^4$ are each an alkyl group containing from 1 to 20 carbon atoms, $R^1$ and $R^2$, or $R^3$ and $R^4$ may be bound to each other to form a ring, and (A) is S, S—S, S—S—S, S—S—S—S, S—S—S—S—S, S—S—S—S—S—S, S—$CH_2$—S, S—$CH_2CH_2$—S, or S—$CH_2CH_2CH_2$—S); and (II) a lubricant for improving fatigue life which comprises:

(1) a lubricating base material;

(2) Compound (a) represented by the general formula (i);

(3) a molybdenum compound (hereinafter referred to as "Compound (b)") represented by the general formula (ii):

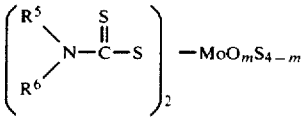

(ii)

(wherein $R^5$ and $R^6$ each contain from 1 to 30 carbon atoms and are each an alkyl group, a cycloalkyl group, an aryl group, or an alkylaryl group, and m is a real number meeting the requirement of $0 \leqq m \leqq 4$) or the general formula (iii):

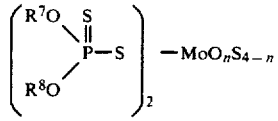

(iii)

(wherein $R^7$ and $R^8$ each contain from 1 to 30 carbon atoms and are each an alkyl group, a cycloalkyl group, an aryl group, or an alkylaryl group, and n is a real number meeting the requirement of $0 \leqq n \leqq 4$); and/or (4) an ester compound (hereinafter referred to as "Compound (c)").

BRIEF DESCRIPTION OF THE DRAWING

The FIGURE is a schematic view of a two-cylinder testing machine used in the Examples and Comparative Examples.

The reference numerals are as follows:

Figure 1:
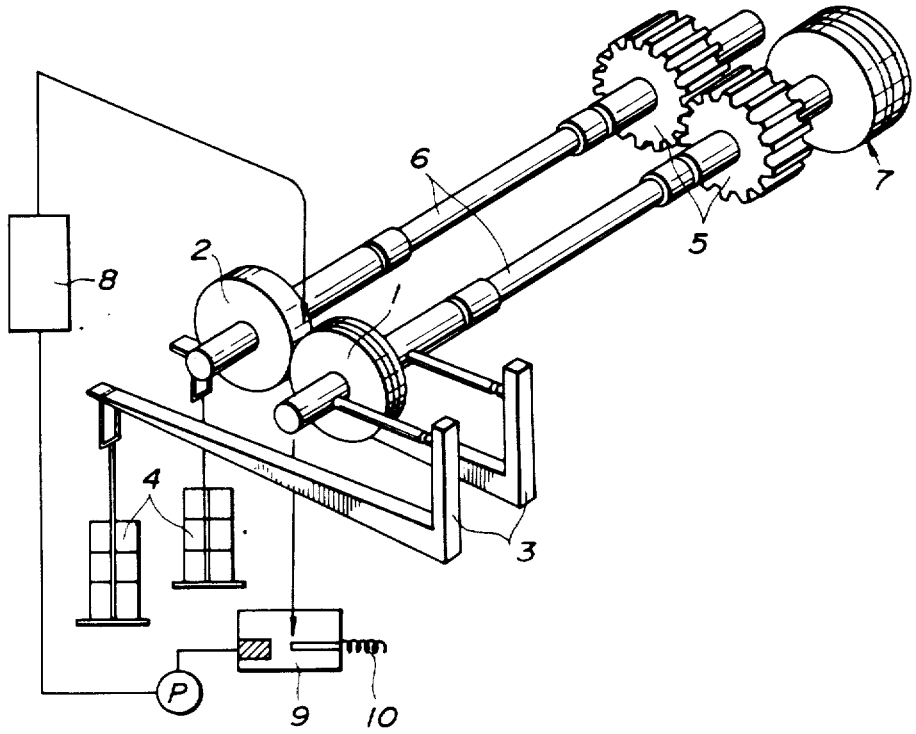

1—Test specimen on the driving cylinder,
2—Test specimen on the cylinder to be driven,
3—Load lever,
4—Weight,
5—Transmission gear,
6—Universal joint,
7—V-shaped belt,
8—Filter,
9—Oil tank,
10—Heater.

DETAILED DESCRIPTION OF THE INVENTION

The present invention provides:

(I) a lubricant for improving fatigue life (hereinafter referred to as "Lubricant (I)") which comprises (1) a lubricating base material and (2) Compound (a) represented by the general formula (i); and (II) a lubricant for improving fatigue life (hereinafter referred to as "Lubricant (II)") which comprises (1) a lubricating base material, (2) Compound (a) represented by the general formula (i), (3) Compound (b) represented by the general formula (ii) or (iii), and/or (4) Compound (c).

Various types of lubricants, greases, etc. can be used as lubricating base materials in the present invention. In addition to mineral oils, synthetic oils can be used, and furthermore, their mixtures can be used.

Specific examples of Compound (a) represented by the general formula (i) are methylenebis(dibutyldithiocarbamate) represented by

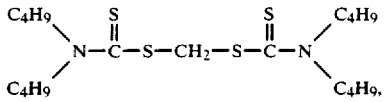

ethylenebis(dibutyldithiocarbamate) represented by

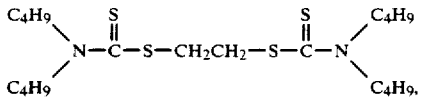

trimethylenebis(dibutyldithiocarbamate) represented by

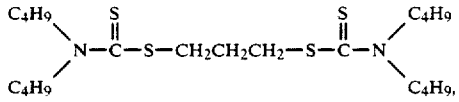

bis(dimethylthiocarbamoyl)monosulfide represented by

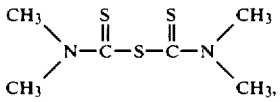

bis(dimethylthiocarbamoyl)disulfide represented by

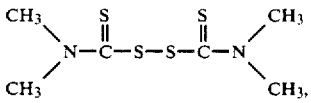

bis(dimethylthiocarbamoyl)trisulfide represented by

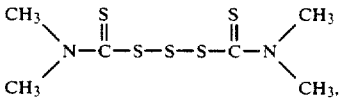

bis(dibutylthiocarbamoyl)disulfide represented by

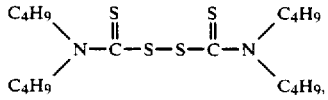

bis(diamylthiocarbamoyl)disulfide represented by

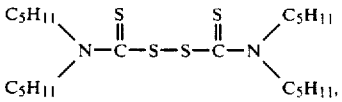

bis(dioctylthiocarbamoyl)disulfide represented by

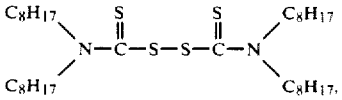

bis(didecylthiocarbamoyl)disulfide represented by

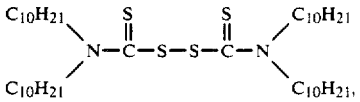

bis(dioctadecylthiocarbamoyl)disulfide represented by

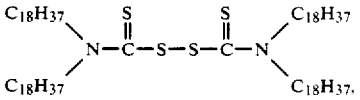

methylenebis(butyloctyldithiocarbamate) represented by

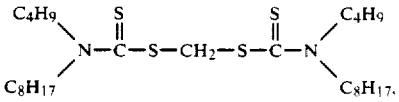

diethylthiocarbamoyl diamylthiocarbamoyl disulfide represented by

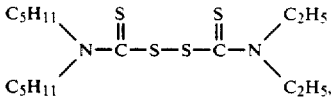

dibutylthiocarbamoyl dinonylthiocarbamoyl disulfide represented by

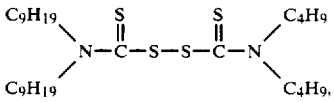

and di(pentamethylenethiocarbamoyl)hexasulfide represented by

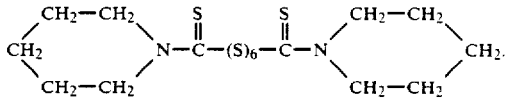

The amount of Compound (a) being added is not critical; it is usually from 0.01 to 10% by weight, preferably from 0.05 to 5% by weight, based on the total amount of the lubricant.

Lubricant (I) of the invention is prepared by adding Compound (a) to the lubricating base material. By using Lubricant (I) of the invention as a lubricant for gears, etc., the fatigue life of the gears, etc. can be prolonged.

Lubricant (II) of the invention is prepared by adding Compound (b) and/or Compound (c) as well as Compound (a) to the lubricating base material. Compound (b) as used herein refers to molybdenum compounds represented by the general formula (ii) or (iii).

Typical examples of the molybdenum compounds represented by the general formula (ii) include thiomolybdenum diethyldithiocarbamic acid sulfide represented by

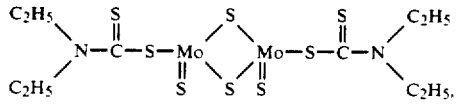

thiomolybdenum dipropyldithiocarbamic acid sulfide represented by

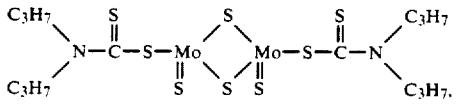

thiomolybdenum diamyldithiocarbamic acid sulfide represented by

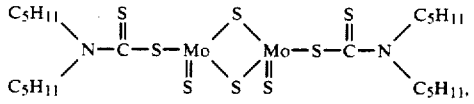

thiomolybdenum di(2-ethylhexyl)dithiocarbamic acid sulfide represented by

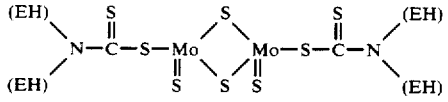

wherein EH is 2-ethylhexyl group), thiomolybdenum dilauryldithiocarbamic acid sulfide represented by

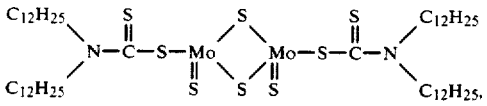

thiomolybdenum diethyldithiocarbamic acid oxide represented by

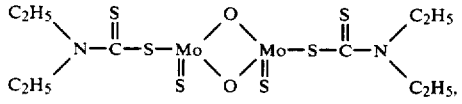

thiomolybdenum oxymolybdenum diethyldithiocarbamic acid oxide represented by

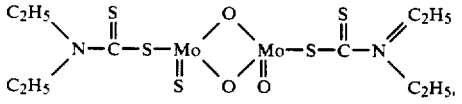

oxymolybdenum diethyldithiocarbamic acid oxide represented by

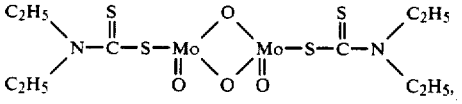

thiomolybdenum di(nonylphenyl)carbamic acid sulfide represented by

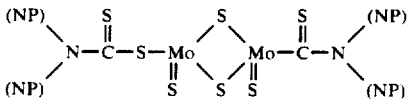

(wherein NP is nonylphenyl group), thiomolybdenum propyloctyldithiocarbamic acid sulfide represented by

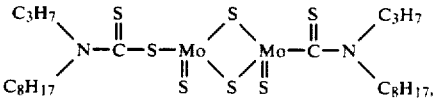

thiomolybdenum dioctacosyldithiocarbamic acid sulfide represented by

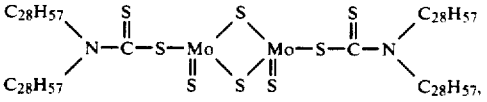

and thiomolybdenum di(cyclohexyl)dithiocarbamic acid sulfide represented by

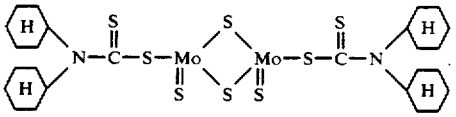

Typical examples of the molybdenum compounds represented by the general formula (iii) include oxymolybdenum diisopropylphosphoro dithioate sulfide represented by

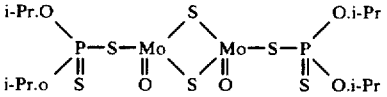

(wherein i-Pr is isopropyl group), oxymolybdenum diisobutylphosphoro dithioate sulfide represented by

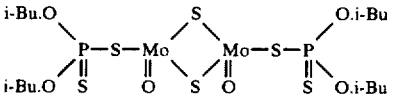

(wherein i-Bu is isobutyl group), oxymolybdenum di(2-ethylhexyl)phosphoro dithioate sulfide represented by

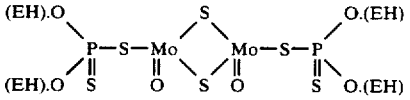

(wherein EH is 2-ethylhexyl group), oxymolybdenum di(p-tert.-butylphenyl)phosphoro dithioate sulfide represented by

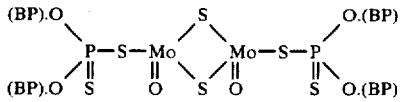

(wherein BP is p-tert.-butylphenyl group), oxymolybdenum di(nonylphenyl)phosphoro dithioate sulfide represented by

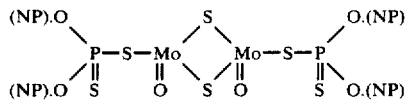

(wherein NP is nonylphenyl group), and oxymolybdenum ditetracosylphosphoro dithioate sulfide represented by

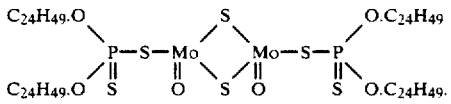

Compound (c) as used herein refers to ester compounds. Typical examples of the ester compounds are phosphoric acid esters or their amine salts, esters of higher aliphatic acids and alcohols, and dibasic acid esters. Specific examples of the phosphoric acid esters include monobutyl acid phosphate represented by

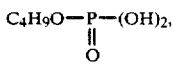

mono-2-ethylhexyl acid phosphate represented by

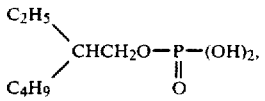

monolauryl acid phosphate represented by

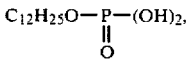

dibutyl hydrogen phosphite represented by

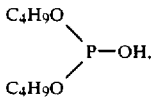

monooleyl acid phosphate represented by

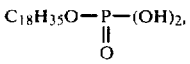

dilauryl hydrogen phosphite represented by

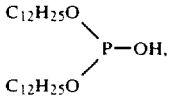

distearyl hydrogen phosphite represented by

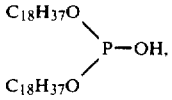

dioleyl hydrogen phosphite represented by

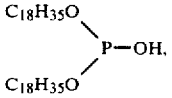

diphenyl hydrogen phosphite represented by

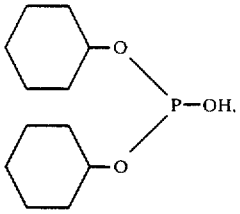

dibutyl acid phosphate represented by

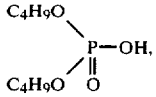

di-2-ethylhexyl acid phosphate represented by

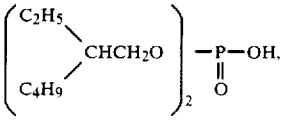

dilauryl acid phosphate represented by

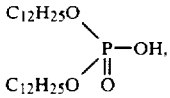

dioleyl acid phosphate represented by

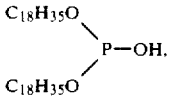

diethylamine salt of dibutyl acid phosphate represented by

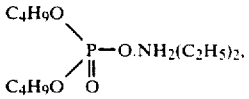

and mono tertiary $C_{12}$–$C_{14}$ alkyl amine salt of a mixture of monooleyl acid phosphate and dioleyl acid phosphate. The higher aliphatic acids used preferably in the esters of higher aliphatic acids and alcohols are higher aliphatic acids which are in the solid state at room temperatures and have more than 9 carbon atoms. More preferably, they have from 12 to 22 carbon atoms. The alcohols used preferably in the esters of higher aliphatic acids and alcohols have less than 19 carbon atoms. Specific examples include isopropyl palmitate, butyl palmitate, octyl palmitate, myristyl palmitate, isopropyl myristate, myristyl myristate, methyl stearate, butyl stearate, octyl sterate, methyl oleate, lauryl oleate, oleyl oleate, and oleyl behenate. Specific examples of dibasic acid esters include dibutyl sebacate, di-2-ethylhexyl sebacate, dioctyl sebacate, di-2-ethylhexyl adipate, and dioctyl adipate.

In Lubricant (II) of the invention, any one or both of Compounds (b) and (c) are added. The amount of each of Compounds (b) and (c) being added is not critical and can be determined appropriately. For example, the amount of Compound (b) added is from 0.01 to 20% by weight, preferably from 0.05 to 5% by weight based on the total amount of the lubricant, and the amount of Compound (c) added is from 0.05 to 50% by weight, preferably from 0.1 to 20% by weight based on the total amount of the lubricant.

In the lubricants of the invention, in addition to the above-described components, if necessary, extreme pressure additives, detergent dispersants, antioxidants, corrosion inhibitors, etc. can be added appropriately.

When Lubricant (I) or (II) of the invention is applied on the surface of each mechanical part, e.g., gears and bearings, by techniques such as coating, spraying, and dipping, the fatigue life of the part can be greatly prolonged. In respect of the effect of prolonging the fatigue life, Lubricant (II) is superior to Lubricant (I).

The lubricants of the invention can be used widely and effectively as lubricants such as gear oil, bearing oil, sliding surface lubricating oil, chain lubricating oil, and engine oil, or as greases to be used in various applications.

The present invention is described in greater detail by reference to the following Examples and Comparative Examples.

EXAMPLES 1 TO 10 AND COMPARATIVE EXAMPLES 1 TO 3

A two-cylinder testing machine as shown in the FIG. 1 was used. The two cylinders (one specimen on the driving side and the other on the side to be driven) were repeatedly brought into rolling contact and sliding contact with each other, and the differences in fatigue life between the lubricants having the compositions shown in the Table (viscosity: 100±2 centistokes (40° C.) for all lubricants) were determined. The results are shown in the Table.

The test specimens, experimental conditions, and method of determination of fatigue life were as follows:

Test Specimens

Material from which the test specimens were prepared:

SCM-3 (both of the driving side and the side to be driven)

Diameter×Length: 60 millimeters×20 millimeters (both of the driving side and the side to be driven)

Hardness (HB): 350 (the driving side), 300 (the side to be driven)

Surface Roughness (Rmax): 3 micrometers (μm) (both of the driving side and the side to be driven)

Experimental Conditions

Number of Revolutions: 1,500 revolutions per minute (r.p.m.)

Specific Sliding: −18%

Sliding Speed: 0.7 meter per second

Contact Pressure (Hmax): 75 kilograms per square millimeter (kg/mm$^2$)

Determination of Fatigue Life

Every three hours after the start of the operation, the testing machine was stopped and the test specimens were examined with the naked eye. The number of contacts (number of revolutions×time) counted until ten damages of at least 0.5 millimeter were formed in the surface of the test specimen mounted on the side to be driven was determined as a fatigue life. On basis of the value of fatigue life, a life, $L_{50}$, at a damage-formation rate of 50% was determined according to the Weibull plot. In the case of paraffin-based base material, the life ($L_{50}$) was $4.7\times10^6$. In the same manner as above, the life of each lubricant was determined as a relative value in relation to the foregoing base material.

TABLE 1

| | Ex. 1 | Ex. 2 | Ex. 3 | Ex. 4 | Ex. 5 | Ex. 6 | Ex. 7 | Ex. 8 | Ex. 9 | Ex. 10 | Comparative Ex. 1 | Comparative Ex. 2 | Comparative Ex. 3*4 |
|---|---|---|---|---|---|---|---|---|---|---|---|---|---|
| PROPORTION OF EACH COMPONENT (wt %) | | | | | | | | | | | | | |
| Paraffin-Based Base Material | 99.7 | 99.7 | 99.5 | 99.3 | 99.2 | 99.2 | 98.8 | 94.3 | 94.3 | 96.4 | 100 | 99.0 | |
| Compound (a) | | | | | | | | | | | | | |
| Bis(dibutylthiocarbamoyl)-disulfide | 0.3 | 0.1 | — | 0.2 | — | 0.1 | 0.2 | 0.2 | — | 0.1 | — | — | |
| Methylenebis(dibutyl-dithiocarbamate) | — | 0.2 | — | — | 0.3 | — | — | — | 0.2 | — | — | — | |
| Bis(dibutylthiocarbamoyl)-sulfide | — | — | 0.5 | — | — | 0.1 | — | — | — | 0.2 | — | — | |
| Compound (b) | | | | | | | | | | | | | |
| MoDTC*1 | — | — | — | 0.5 | — | 0.3 | 0.5 | — | 0.5 | — | — | — | |
| MoDTP*2 | — | — | — | — | 0.5 | 0.3 | — | 0.5 | — | — | — | — | |
| Compound (c) | | | | | | | | | | | | | |
| Amine salt of oleyl acid phosphate*3 | — | — | — | — | — | — | 0.5 | — | — | 0.3 | — | — | |
| Octyl palmitate | — | — | — | — | — | — | — | 5.0 | — | — | — | — | |
| Dioctyl adipate | — | — | — | — | — | — | — | — | 5.0 | 3.0 | — | — | |
| Sulfur-Phosphorus Extreme Pressure Additive | — | — | — | — | — | — | — | — | — | — | — | 1.0 | |

TABLE 1-continued

| | Ex. 1 | Ex. 2 | Ex. 3 | Ex. 4 | Ex. 5 | Ex. 6 | Ex. 7 | Ex. 8 | Ex. 9 | Ex. 10 | Comparative Ex. 1 | Comparative Ex. 2 | Comparative Ex. 3*4 |
|---|---|---|---|---|---|---|---|---|---|---|---|---|---|
| RELATIVE VALUE OF FATIGUE LIFE | 150 | 145 | 150 | 185 | 185 | 175 | 205 | 200 | 205 | 205 | 100 | 50 | 55 |

*1Thiomolybdenum diamyldithiocarbamic acid sulfide
*2Oxymolybdenum-(2-ethylhexyl)phosphoro dithioate sulfide
*3Mono tertiary $C_{12}$—$C_{14}$ alkyl amine salt of a mixture of monooleylacid phosphate and dioleyl acid phosphate
*4Commercially available SP (sulfur-phosphorus)-based gear oil

What is claimed is:

1. A lubricant for improving fatigue life which comprises:
   (1) a lubricating base material; and
   (2) a compound having alkylthiocarbamoyl groups represented by the formula (i):

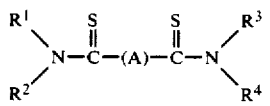

(i)

wherein $R^1$, $R^2$, $R^3$, and $R^4$ are each an alkyl group containing from 1 to 20 carbon atoms, $R^1$ and $R^2$, or $R^3$ and $R^4$ may be bound to each other to form a ring, and (A) is selected from the group consisting of S, S—S, S—S—S, S—S—S—S, S—S—S—S, and S—S—S—S—S—S.

2. The lubricant as claimed in claim 1, wherein the proportion of the compound having alkylthiocarbamoyl groups is from 0.01 to 10% by weight of the total weight of the lubricant.

3. A lubricant for improving fatigue life which comprises:
   (1) a lubricating base material;
   (2) a compound having alkylthiocarbamoyl groups represented by formula (i):

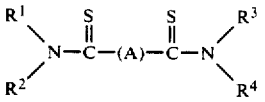

(i)

wherein $R^1$, $R^2$, $R^3$, and $R^4$ are each an alkyl group containing from 1 to 20 carbon atoms, $R^1$ and $R^2$, or $R^3$ and $R^4$ may be bound to each other to form a ring, and (A) is S, S—S, S—S—S, S—S—S—S, S—S—S—S—S, S—S—S—S—S—S, S—$CH_2$—S, S—$CH_2CH_2$—S, or S—$CH_2CH_2CH_2$—S; and at least one compound selected from
   (3) a molybdenum compound represented by formula (ii) or (iii):

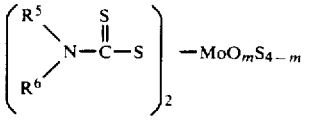

(ii)

wherein $R^5$ and $R^6$ each contain from 1 to 30 carbon atoms and are each selected from the group consisting of an alkyl group, a cycloalkyl group, an aryl group, and an
alkylaryl group, and m is a real number meeting the requirement of $0 \leqq m \leqq 4$;

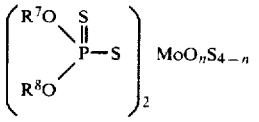

(iii)

wherein $R^7$ and $R^8$ each contain from 1 to 30 carbon atoms and are each selected from the group consisting of an alkyl group, a cycloalkyl group, an aryl group, and an alkylaryl group, and n is a real number meeting the requirement of $0 \leqq n \leqq 4$; and
   (4) an ester compound.

4. The lubricant as claimed in claim 3, wherein the proportion of the compound having alkylthiocarbamoyl groups is from 0.01 to 10% by weight of the total weight of the lubricant.

5. The lubricant as claimed in claim 3, wherein the proportion of the molybdenum compound is from 0.01 to 20% by weight of the total weight of the lubricant.

6. The lubricant as claimed in claim 3, wherein the proportion of the ester compound is from 0.05 to 50% by weight of the total weight of the lubricant.

7. The lubricant as claimed in claim 3, wherein the ester compound is selected from the group consisting of phosphoric acid esters and amine salts thereof, esters of higher aliphatic acids, esters of higher aliphatic alcohols and dibasic acid esters.

8. The lubricant as claimed in claim 5, wherein the proportion of the compound having alkylthiocarbamoyl groups is from 0.01 to 10% by weight of the total weight of the lubricant.

9. The lubricant as claimed in claim 4, wherein the proportion of the ester compound is from 0.05 to 50% by weight of the total weight of the lubricant.

10. The lubricant as claimed in claim 5, wherein the proportion of the ester compound is from 0.05 to 50% by weight of the total weight of the lubricant.

11. A method of inhibiting metal fatigue in machines containing moving parts composed of said metal, said method comprising treating said moving parts with a metal fatigue inhibiting effective amount of the lubricant of claim 1.

12. The method as claimed in claim 11, wherein the proportion of the compound having alkylthiocarbamoyl groups is from 0.01 to 10% by weight of the total weight of the lubricant.

13. A method of inhibiting metal fatigue in machines containing moving parts composed of said metal, said method comprising treating said moving parts with a metal fatigue inhibiting effective amount of the lubricant of claim 3.

14. The method as claimed in claim 13, wherein the proportion of the compound having alkylthiocarbamoyl groups is from 0.01 to 10% by weight of the total weight of the lubricant.

15. The method as claimed in claim 13, wherein the proportion of the molybdenum compound is from 0.01 to 20% by weight of the total weight of the lubricant.

16. The method as claimed in claim 13, wherein the proportion of the ester compound is from 0.05 to 50% by weight of the total weight of the lubricant.

17. The method as claimed in claim 13, wherein the ester compound is selected from the group consisting of phosphoric acid esters and amine salts thereof, esters of higher aliphatic alcohols and dibasic acid esters.

18. The method as claimed in claim 15, wherein the proportion of the compound having alkylthiocarbamoyl groups is from 0.01 to 10% by weight of the total weight of the lubricant.

19. The method as claimed in claim 14, wherein the proportion of the ester compound is from 0.05 to 50% by weight of the total weight of the lubricant.

20. The method as claimed in claim 15, wherein the proportion of the ester compound is from 0.05 to 50% by weight of the total weight of the lubricant.

* * * * *